US008945465B2

(12) United States Patent
Reeves et al.

(10) Patent No.: US 8,945,465 B2
(45) Date of Patent: Feb. 3, 2015

(54) COMPRESSIVE ROD ASSEMBLY FOR MOLTEN METAL CONTAINMENT STRUCTURE

(75) Inventors: Eric W. Reeves, Hayden Lake, ID (US); James E. Boorman, Greenacres, WA (US); Jason D. Hymas, Fairfield, WA (US); Robert Bruce Wagstaff, Greenacres, WA (US); Randy Womack, Spokane Valley, WA (US)

(73) Assignee: Novelis Inc., Atlanta, GA (US)

( * ) Notice: Subject to any disclaimer, the term of this patent is extended or adjusted under 35 U.S.C. 154(b) by 279 days.

(21) Appl. No.: 12/928,355

(22) Filed: Dec. 8, 2010

(65) Prior Publication Data

US 2011/0140322 A1 Jun. 16, 2011

Related U.S. Application Data

(60) Provisional application No. 61/283,905, filed on Dec. 10, 2009.

(51) Int. Cl.
*C21B 3/00* (2006.01)
*B22D 41/00* (2006.01)
(Continued)

(52) U.S. Cl.
CPC ..... *B22D 41/00* (2013.01); *F27D 1/0023* (2013.01); *F27D 1/0026* (2013.01); *F27D 1/145* (2013.01); *C21B 7/14* (2013.01)
USPC ..... 266/275; 432/251

(58) Field of Classification Search
CPC ..... B22D 41/00; C21B 7/14; F27D 1/145; F27D 1/0026; F27D 1/0023
USPC ..... 266/275; 432/251, 252; 202/268; 411/544, 531, 190
See application file for complete search history.

(56) References Cited

U.S. PATENT DOCUMENTS 3,295,280 A * 1/1967 Kettner ..... 52/378
3,523,395 A * 8/1970 Konrad et al. ..... 52/410
(Continued)

FOREIGN PATENT DOCUMENTS

CA 2116703 A1 2/1995
CN 2915881 6/2007
(Continued)

OTHER PUBLICATIONS

U.S. Appl. No. 12/928,354, filed Dec. 8, 2010, Reeves et al.
(Continued)

*Primary Examiner* — Scott Kastler
*Assistant Examiner* — Michael Aboagye
(74) *Attorney, Agent, or Firm* — Kilpatrick Townsend & Stockton LLP

(57) ABSTRACT

Exemplary embodiments of the invention relate to a compressive rod assembly for applying force to a refractory vessel positioned within an outer metal casing. The assembly includes a rigid elongated rod having first and second opposed ends, a threaded bolt adjacent to the first opposed end of the elongated rod, and a compressive structure positioned operationally between the elongated rod and the bolt. Compressive force applied by the bolt to the elongated rod passes through the compressive structure which allows limited longitudinal movements of the elongated rod to be accommodated by the compressive structure without requiring corresponding longitudinal movements of the bolt. Exemplary embodiments also relate to rod structure forming a component of the assembly, and to a metal containment structure having a vessel supported and compressed by at least one such assembly.

16 Claims, 4 Drawing Sheets

(51) Int. Cl.

| | |
|---|---|
| ***F27D 1/00*** | (2006.01) |
| ***F27D 1/14*** | (2006.01) |
| *C21B 7/14* | (2006.01) |

(56) References Cited

U.S. PATENT DOCUMENTS

| | | | | | |
|---|---|---|---|---|---|
| 3,909,907 | A | | 10/1975 | Davis | |
| 4,498,521 | A | | 2/1985 | Takeda et al. | |
| 4,531,717 | A | | 7/1985 | Hebrant | |
| 4,552,623 | A | * | 11/1985 | Urbye et al. | 202/248 |
| 4,567,935 | A | | 2/1986 | Takeda et al. | |
| 4,732,652 | A | | 3/1988 | Durselen et al. | |
| 5,031,882 | A | | 7/1991 | Van Laar et al. | |
| 5,129,631 | A | | 7/1992 | Van Laar | |
| 5,228,250 | A | * | 7/1993 | Kesselman | 52/98 |
| 5,316,071 | A | | 5/1994 | Skinner et al. | |
| 6,973,955 | B2 | | 12/2005 | Tingey et al. | |
| 7,900,487 | B2 | | 3/2011 | Lim | |
| 2006/0198717 | A1 | * | 9/2006 | Fuest | 411/401 |
| 2008/0163806 | A1 | | 7/2008 | His et al. | |
| 2008/0163999 | A1 | | 7/2008 | Hymas et al. | |
| 2009/0151296 | A1 | * | 6/2009 | Perry | 52/741.4 |

FOREIGN PATENT DOCUMENTS

| | | | |
|---|---|---|---|
| DE | 102007026130 | A1 | 12/2007 |
| DE | 202008013980 | U1 | 1/2009 |
| EP | 2050857 | A1 | 5/1982 |
| EP | 0 466 530 | A1 | 1/1992 |
| FR | 2628520 | A1 | 9/1989 |
| GB | 773272 | | 4/1957 |
| JP | 11277189 | A | 10/1999 |
| JP | 2000326067 | A | 11/2000 |
| JP | 2006112730 | A | 4/2006 |
| KR | 20000030988 | A | 6/2000 |
| NL | 90627 | | 4/1959 |
| WO | WO 95/21273 | A1 | 8/1995 |
| WO | 2008074134 | | 6/2008 |

OTHER PUBLICATIONS

Canadian Intellectual Property Office, International Search Report, Feb. 24, 2011, PCT/CA2010/001937 (Novelis Inc., et al.).

Canadian Patent Application No. 2778436 , Office Action dated Sep. 12, 2013, 3 pages.

European Application No. 10835335.0 , "Extended European Search Report Received" dated Nov. 18, 2013, 5 pages.

Chinese Patent Application No. CN201080055811.1, First Office Action mailed Dec. 13, 2013, 26 pages.

European Patent Application No. EP 10835335.0, Office Action mailed Jul. 18, 2014, 5 pages.

Chinese Patent Application No. CN 201080055811.1, Second Office Action mailed Jun. 26, 2014, 10 pages.

* cited by examiner

COMPRESSIVE ROD ASSEMBLY FOR MOLTEN METAL CONTAINMENT STRUCTURE

CROSS-REFERENCE TO RELATED APPLICATION

This application claims the priority right of prior provisional patent application Ser. No. 61/283,905 filed on Dec. 10, 2009 by applicants herein. The entire content of application Ser. No. 61/283,905 is specifically incorporated herein for all purposes by this reference.

BACKGROUND OF THE INVENTION (1) Field of the Invention

The present invention relates to structures used for containing and conveying molten metal, and to parts of such structures. More particularly, the invention relates to such structures having a refractory or ceramic vessel contained within an outer metal casing used to support, protect and, if necessary, align the refractory vessel.

(2) Description of the Related Art

Metal containment structures of this kind generally include a refractory vessel of some kind, e.g. a molten metal conveying vessel, held within an outer metal casing. The vessel may become extremely hot (e.g. to a temperature of 700° C. to 750° C.) as the molten metal is held within or conveyed through the vessel. If this heat is transferred to the outer metal casing of the containment structure, the metal casing may be subjected to expansion, warping and distortion and (if the vessel is made in sections) may cause gaps to form between the sections of the vessel, thereby allowing molten metal leakage. Additionally, the outer surface of the casing may assume an operating temperature that is unsafe for operators of the equipment. These disadvantages are made worse if additional heating is applied to the vessel to maintain a desired temperature for the molten metal. For example, temperatures of up to 900° C. may be present at the outside of the vessel when vessel heating is employed. Layers of insulation may be provided between the vessel and the interior of the casing, but such layers may not provide rigid support for the vessel and may not make it possible for a gap to be formed between the vessel and the casing for heat circulation when a heated vessel is required.

To overcome such problems, the vessel may be rigidly supported at various spaced positions within the interior of the metal casing, thereby permitting the formation of a thermal isolation gap between the vessel and the casing. Such a gap also allows for heat circulation in distribution systems that apply heat to the vessel. Layers of insulation may then be used to line the interior of the casing on the casing side of the gap to provide further thermal isolation for the metal casing. However, rigid supports cannot accommodate the thermal expansion and shrinkage that the vessel experiences during thermal cycling of the distribution system, and tend not to contain cracks that may form in the vessel.

There is, accordingly, a need for improved means of providing rigid support for a ceramic vessel within a metal casing of a metal distribution structure.

BRIEF SUMMARY OF THE EXEMPLARY EMBODIMENTS

An exemplary embodiment of the invention provides a compressive rod assembly for applying force to a refractory vessel positioned within an outer metal casing, the assembly comprising a rigid elongated rod having first and second opposed ends, a threaded bolt adjacent to the first opposed end of the elongated rod, and a compressive structure positioned operationally between the elongated rod and the bolt, whereby force applied by the bolt to the elongated rod passes through the compressive structure which allows limited longitudinal movements of the elongated rod to be accommodated by the compressive structure without requiring corresponding longitudinal movements of the bolt.

Another exemplary embodiment provides a molten metal containment structure (e.g. a structure for holding, distributing or conveying molten metal), having a refractory vessel positioned within an outer metal casing, the vessel being spaced from internal surfaces of the casing and being subjected to compressive force from at least one compressive rod assembly, the assembly comprising: a rigid elongated rod having first and second opposed ends, with the second end in contact with the vessel within the casing, a threaded bolt adjacent to the first opposed end of the elongated rod and extending outside the casing, and a compressive structure positioned operationally between the elongated rod and the bolt, whereby force applied by the bolt to the elongated rod passes through the compressive structure which allows limited longitudinal movements of the elongated rod to be accommodated by the compressive structure without requiring corresponding longitudinal movements of the bolt.

The vessel may be, for example, an elongated vessel having a metal conveying channel extending from one longitudinal end of the vessel to an opposite longitudinal end, a vessel having an elongated channel for conveying molten metal, the channel containing a metal filter, a vessel having an interior volume for containing and temporarily holding molten metal, and at least one metal degassing unit extending into the interior volume, or vessel designed as a crucible having an interior volume adapted for containing reacting chemicals.

In the structure, each of the plurality of compressive isolation rod assemblies preferably applies a force in a range of 0 to 5,000 lb (0 to 2268 Kg) to the vessel. The vessel preferably has longitudinal side walls and a bottom wall, and some of the compressive isolation rod assemblies preferably contact the longitudinal side walls and/or bottom wall at positions along the vessel spaced by distances of 1.5 to 15 inches (3.8 to 38.1 cm). There is preferably an unfilled gap between the vessel and the casing, and the tubular metal reinforcement terminates short of the gap, e.g. by a distance of 0.0 to 2.0 inches (0 to 5 cm). Alternatively, the tubular metal reinforcement is preferably spaced from the one of the longitudinal ends of the body by a distance of 0.0 to 3.0 inches (0 to 7.6 cm).

The structure may contain a heater for heating the vessel or alternatively the vessel may be unheated, and thermal insulation material may be provided adjacent to an inner surface of the casing.

The rigid rod of the compressive assembly can withstand the high heat of the vessel. Since essentially the only contact between the vessel and the metal casing is via the rigid rod, heat conduction from the walls of the vessel is reduced. The rod thus thermally isolates the vessel from the metal casing. Additionally, the compressive force applied by the rod helps to prevent cracks from forming and tends to contain such cracks when they do form, thereby reducing instances of metal leakage from the vessel.

The vessel is primarily intended for containing or conveying molten aluminium or aluminium alloys, but may be applied for containing or conveying other molten metals and alloys, particularly those having melting points similar to molten aluminium, e.g. magnesium, lead, tin and zinc (which have melting points lower melting points than aluminium)

and copper and gold (which have higher melting points). Iron and steel have much higher melting points, but the structures of the invention may also be designed for such metals, if desired.

Yet another exemplary embodiment provides a rod component for a compressive isolation rod assembly of the above kind, the rod component comprising an elongated rigid rod having first and second opposed ends, and the rod having a refractory heat insulating material adjacent the second opposed end of the rod.

DETAILED DESCRIPTION OF THE EXEMPLARY EMBODIMENTS

Figure 1:
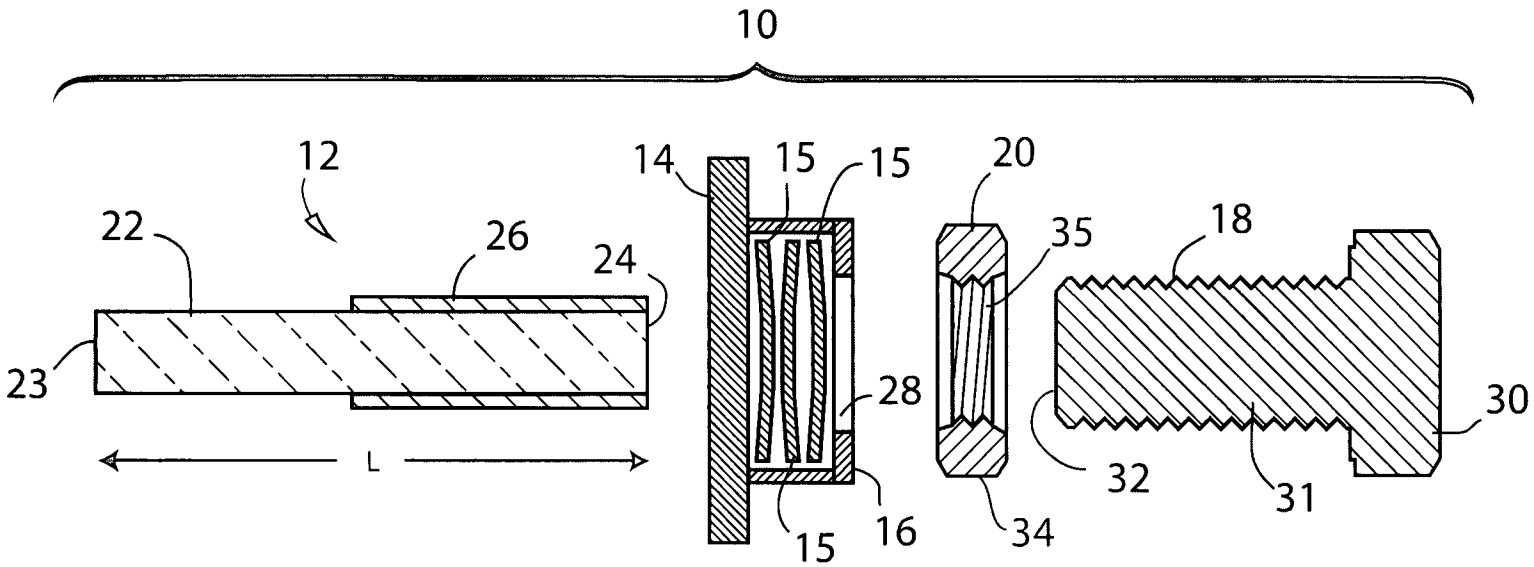
FIG. 1 of the accompanying drawings is a cross-section, in exploded view, of a compressive rod assembly according to one exemplary embodiment of the invention.

FIG. 1 is an exploded longitudinal cross-section of a compressive rod assembly 10 according to one exemplary embodiment. The assembly comprises an elongated rod 12, a metal plate 14, three cupped metal spring washers 15 held within a retainer 16 attached to the plate 14, thereby surrounding the spring washers 15 and retaining them adjacent to the plate, a bolt 18, and an internally threaded nut 20. The rod 12 has an elongated body 22 of refractory, normally ceramic, material in the form an elongated cylinder or column of length "L" extending between a plate contacting end 24 (first end) and a vessel contacting end 23 (second end) of the rod. The refractory material used for the body is preferably alumina (extruded or pressed), but may be another ceramic capable of resisting compression such as, for example, zirconia, fused silica, mullite, to aluminum titanate, or a machinable glass ceramic (e.g. a product sold under the trademark Macor® by Ceramic Substrates and Components Limited of the United Kingdom). The rod 22 is also provided with an encircling tubular metal support 26 that extends from the plate contacting end 24 part of the way along length L of the rod 22, thus terminating a distance short of the vessel contacting end 23. The cupped washers 15, often called "Belleville washers", flatten when an axial force is applied to them, but are resilient and spring back to their original cupped shape when the force is removed. The spring washers are shown as solid discs, but may be provided with small central openings in alternative embodiments. The bolt 18 has an enlarged multi-faceted head 30 at one end and is shaped to correspond to a socket of a tool (not shown) used to rotate the bolt. The head is attached to an elongated externally threaded shaft 31 and has a contact surface 32 at the opposite end of the shaft. The nut 20 has a multi-faceted outer shape 34 so that it can be held against rotation, and an internal threaded bore 35 of a dimension and matching thread count that allows the nut to ride on the threaded shaft 31 when rotated. The retainer 16 has a central hole 28 that is of sufficiently large diameter to allow an end of the bolt 18 to pass therethrough so that the contact surface 32 contacts the washers 15 and may apply axial force to compress the washers.

The rod 22 and preferably the tubular metal support 26 form a replaceable component for the assembly that may require replacement if the rod 22 fails, e.g. by breakage or metal creep caused by exposure to high temperatures.

Figure 2:
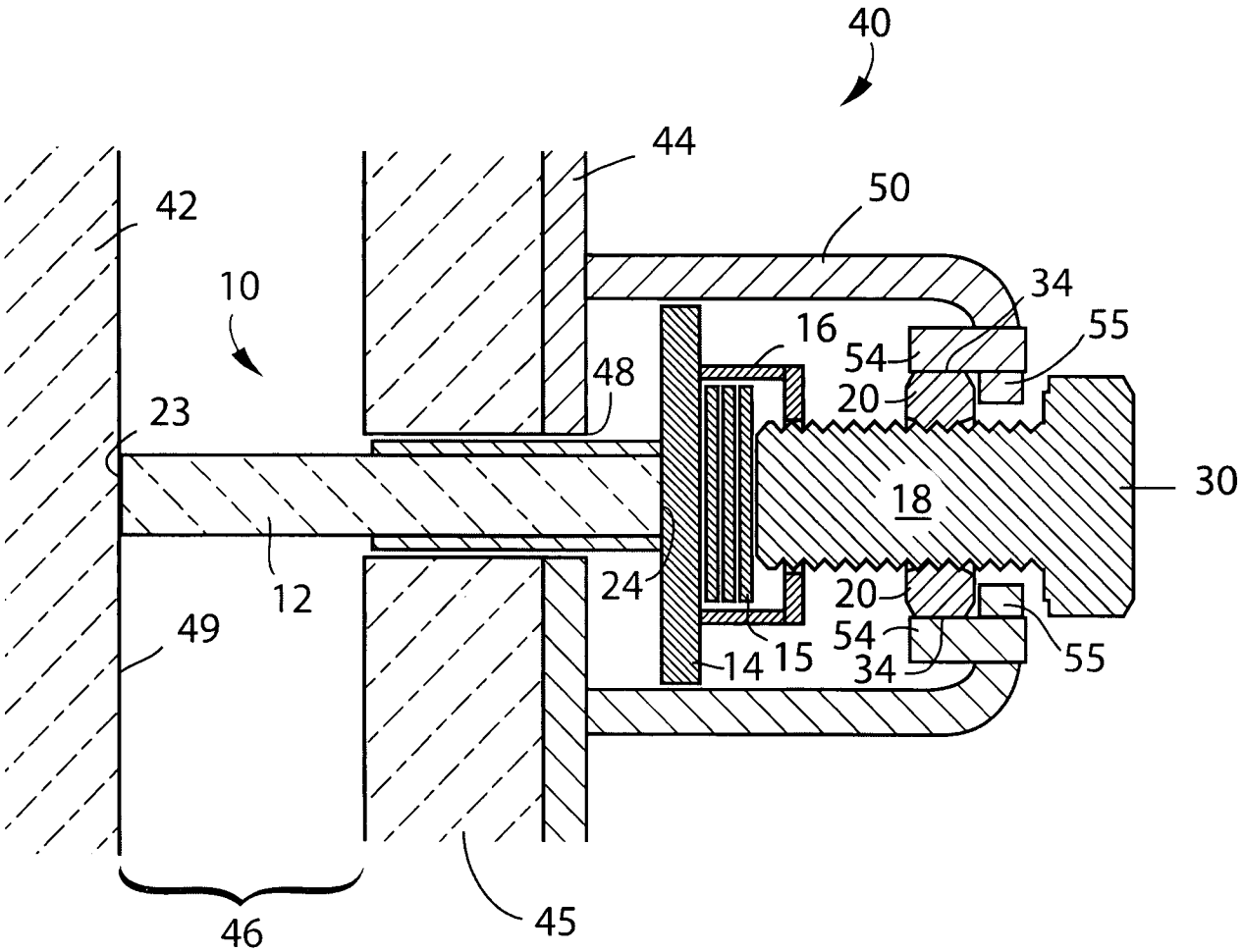
FIG. 2 shows a cross-section of part of a molten metal containment structure provided with the compressive rod assembly of FIG. 1 and also showing a retaining bracket attached to an exterior surface of the containment structure.

The parts of the assembly 10 are shown in assembled form in FIG. 2 in position on part of a molten metal containment structure 40 having a refractory vessel 42 (e.g. a metal-conveying vessel), a metal casing 44 (made of steel, for example) and an internal layer 45 of insulating material (e.g. refractory board). An open or unfilled air gap 46 is present within the structure between the vessel 42 and the layer 45 of insulating material adjacent to an internal surface of the metal casing 44. The gap is spanned by the elongated rod 12 which passes through a hole 48 in the casing 44 and insulating layer 45 so that the vessel contacting end 23 of the rod contacts an outer surface 49 of the vessel 42. The rod 12 is of sufficient length that the plate contacting end 24 of the rod is positioned outside the casing 44. A U-shaped bracket 50 is attached to the casing 44 (e.g. by welding) to surround the plate 14, retainer 16 and the nut 20. In fact, the outer end of the bracket 50 has a central hole provided with contact plates 54 that engage the outer surface 34 of the nut and thereby prevent rotation of the nut. The bracket also has stops 55 that prevent rearward axial motion of the nut 20 along the axis of the bolt. The sides of the bracket 50 adjacent to the casing 44 also prevent rotation of the plate 14 (which is normally square or rectangular in shape) because of the close positioning thereto, but longitudinal movement of the plate 14 is not prevented by the sides of the bracket. When the vessel contacting end 23 contacts the vessel as shown and the bolt 30 is rotated so that it moves into contact with the washers 15, the rod is forced against the vessel, but the cupped washers 15 act as springs that allow the rod 12 to move slightly towards or away from the vessel 42 to accommodate expansion or contraction of the vessel during thermal cycles without requiring any axial movement of the bolt 30. The bolt should preferably not be tightened to the extent that the spring washers 15 are fully compressed because they then lose their ability to accommodate expansion of the vessel. The rod 12 is thus held firmly but resiliently against the vessel and it applies compressive force to the sides of the vessel.

Figure 3:
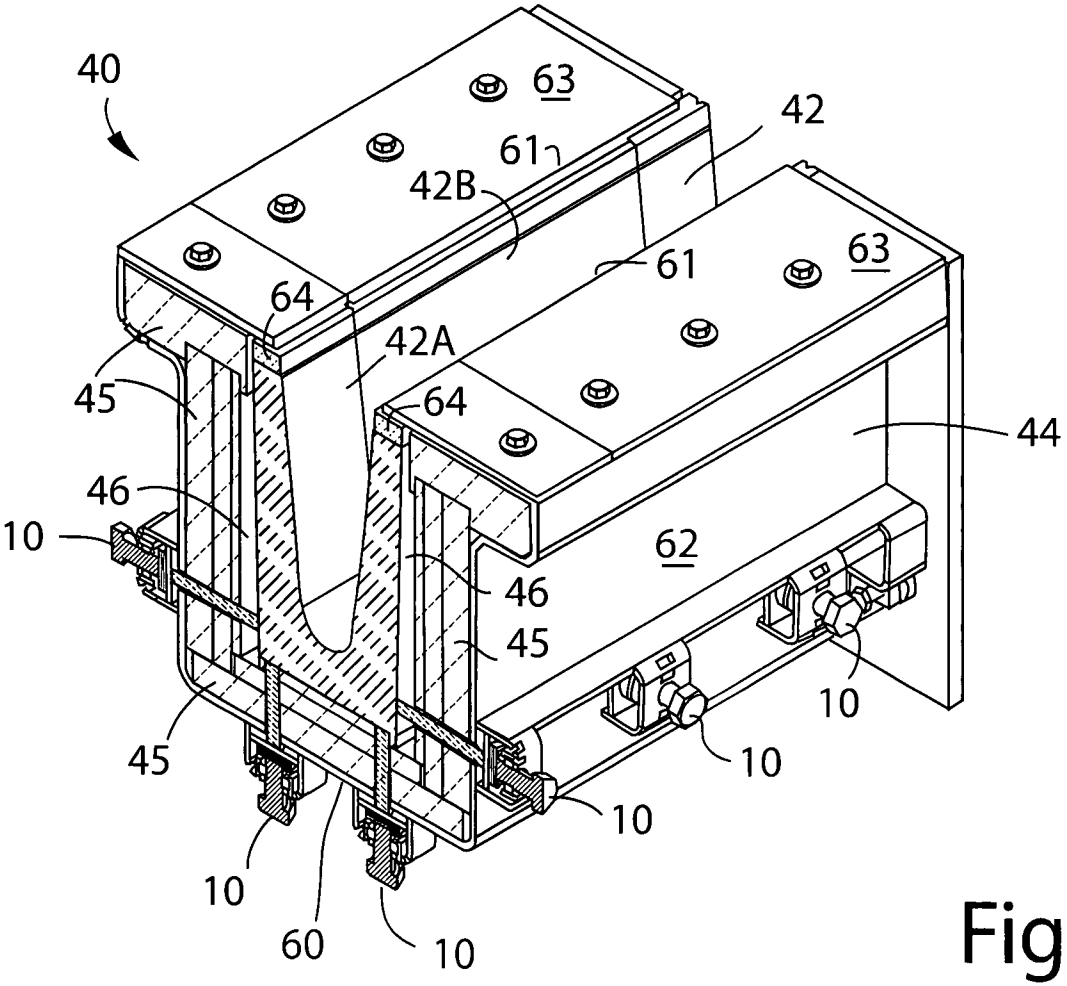
FIG. 3 is a perspective view, partly in cross-section, of a molten metal containment structure similar to that of FIG. 2, but showing additional compressive isolation rod assemblies supporting the molten metal containment vessel thereof.

As will be seen in FIG. 3, the vessel 42 of this exemplary embodiment is an elongated refractory ceramic molten metal conveying vessel of a molten metal distribution structure provided with an elongated metal-conveying channel as shown. The vessel 42 is supported at its lower end by adjacent pairs of rod assemblies 10 of the kind shown in FIG. 2 extending vertically through a bottom wall 60 of the metal casing 44. The vessel is supported by these pairs of vertical assemblies and is held spaced from the bottom wall 60 and compression is also applied to the vessel by these assemblies because the top of the vessel is trapped beneath metal top plates 63 bolted to, and forming part of, the metal casing 44. Preferably, insulating refractory strips 64 are positioned between the top edges of the vessel 42 and overhanging inner lips 61 of top plates 63 to further reduce heat loss from the vessel at these locations. The strips 64 are rigid and act as stops that permit compressive force to be applied by the lower assemblies 10. The insulating refractory strips 64 are preferably kept as narrow as possible in the transverse horizontal dimension to minimize heat conduction away from the vessel and into the top plate 63. The bottom part of the vessel 42 is also fixed in place against lateral movement by opposing pairs of horizontal rod assemblies 10 extending through side walls 62 of the metal casing 44. These assemblies apply opposed counterbalancing compressive forces to the vessel from opposite sides and they are generally positioned at a vertical level beneath the vessel channel where the refractory material extends completely from one side of the vessel to the other so that inward bending or flexing of the vessel sides is avoided. Several such groups of bottom wall and side wall rod assemblies 10 are arranged at spaced intervals along the length of the distribution structure to provide multiple positions of support and compression for the refractory vessel 42. The mutual longitudinal spacing of such groups of assemblies is not critical, but is preferably within the range of 1.5 to 15 inches (3.8 to 38 cm), and more preferably 6 to 10 inches (15.2 to 25.4 cm).

Although FIG. 3 shows the use of assemblies 10 to provide both vertical support/compression and horizontal support/compression, other exemplary embodiments may provide vertical support/compression alone or horizontal support/compression alone, as required according to the size and operational circumstances of the metal distribution structure. In any event, the assemblies isolate the vessel thermally from the casing.

The interior of the metal casing is lined with layers of refractory thermal insulation 45 to further reduce heat conduction to the metal casing. Such layers do not provide significant physical support to the vessel 42 and, indeed, do not touch the vessel, at least at the vertical sides of the vessel as shown where there is an air gap 46 to provide further thermal isolation of the vessel 42. Of course, if desired, the entire space between the metal casing and the vessel may be filled with refractory insulation and, in the embodiment of FIG. 3, no air gap has been provided below the vessel 42 as shown.

Although the embodiment of FIG. 3 does not employ internal heaters for the vessel 42, the side air gaps 46 may, if desired, be provided with electrical heating elements (not shown) to transfer heat to the vessel in order to keep the molten metal contents at a desired high temperature. Alternatively, the vessel may be heated by means disclosed, for example, in U.S. Pat. No. 6,973,955 issued to Tingey et al. on Dec. 13, 2005, and pending U.S. patent application Ser. No. 12/002,989, published on Jul. 10, 2008 under publication no. US 2008/0163999 to Hymas et al. (the disclosures of which patent and patent application are specifically incorporated herein by this reference). The patent to Tingey et al. provides electrical heating from below, and the application to Hymas et al. provides heating by circulation of combustion gases. In still further alternative embodiments, heating means may be located inside or above the refractory vessel itself.

When vessel heaters are employed, it is preferable that the tubular metal supports 26 for the rod 12 not be directly exposed to the heated atmosphere within the air gap 46. In such cases, the metal supports should terminate within the layer of insulating material 45 (see FIG. 2) with only the uncovered ceramic body 22 exposed within the gap. Thus, the metal support preferably covers the whole length of the ceramic body 22 except for the part within the gap 46 plus an additional spacing in a range of 0.13 to 0.38 inches (3 mm to 1 cm). Frequently, the gap ranges in size from 0.25 to 1.5 inches (6 mm to 3.8 cm), so the metal support 26 then covers the whole length of the ceramic body except for 0.38 to 1.88 inches (1 cm to 4.8 cm) from the vessel contacting end 23. For unheated metal distribution systems, all but the last 0.13 to 0.5 inch (3 mm to 1.3 cm) of the ceramic body 22 adjacent to the vessel is preferably covered by the tubular metal support 26. This is sufficient to provide thermal isolation of the vessel by the rod 12 while providing maximum support for the ceramic body.

The lengths L of rods 12 may vary to fit metal distribution systems of different sizes. However, lengths often vary from 1.5 to 12 inches (3.8 cm to 30.5 cm) or longer, and more usually 3 to 5 inches (7.6 cm to 12.7 cm).

Heat conduction of the rod 12 is advantageously reduced as the diameter of the ceramic body 22 is reduced, but compressive strength is disadvantageously reduced and brittleness may be increased, so there is normally an optimum range of thickness that minimizes heat conduction while retaining sufficient strength. This optimum range depends on the material used for the refractory rod 22 but is preferably in the range of 0.25 to 3.0 inches (6 mm to 7.6 cm), and more preferably 0.5 to 1.25 inches (1.3 cm to 3.2 cm).

As noted previously, the bolt 18 is normally tightened so that the rod 12 exerts a compressive force against the vessel 42. Preferably, this compressive force is in the range of 0 to 5,000 lb (0 to 2668 Kg), and more preferably 800 to 1,200 lb (363 to 544 Kg). A zero force is included in the larger range because the rod still functions if it prevents the vessel from moving without actually applying a force until the vessel presses against the rod under thermal load or due to the development of a crack.

The rods carry the compressive load applied to the vessel and so the ceramic material of the rods 22 is chosen to work under such loads without shattering or breaking. As an example, a 1,200 lb (544 Kg) compressive design load on a rod having a diameter of 0.625 inch (1.6 cm) produces a pressure of almost 4,000 psi (27.6 MPa) and, in practice, the pressure may be as high as 5,000 lb (2268 Kg), which produces a pressure of 16.3 ksi (112.4 MPa) on the rod. Rods made of alumina are available with a compressive strength of 300 ksi (2068.4 MPa) and higher, and so are suitable for most or all such applications. Other ceramics may have compressive strengths as low as 50 ksi (344.7 MPa), and are thus still acceptable for many applications. It should be kept in mind that material strengths are typically given for materials at room temperature, and will be moderately to greatly reduced at elevated temperatures, so it is advisable to choose materials having strength values much greater than those likely to be encountered. Because of its very high compressive strength, alumina is preferred for most applications.

It should be noted that although the rod 22 is preferably a cylinder or column of refractory material, it may be tubular or hollow. This further minimizes the area of contact between the end 23 of the rod and the vessel wall, thereby further reducing heat conduction from the vessel. The high strength of alumina, in particular, makes this possible without significantly increased risk of rod breakage. The rod 22 may also be of any desirable cross-sectional shape, e.g. circular, oval, triangular, square, rectangular, polygonal, etc.

The supporting metal tube 26 is preferably long enough provide good support for the refractory rod, but should terminate a sufficient distance short of the vessel contacting end 23 to avoid providing an increase in heat conduction from the vessel. The tube should be thick enough to contain the rod, if the rod should shatter in use, with enough strength to still apply a compressive load. A preferred wall thickness of the tube is at least 0.1 inch (3 mm), with a more preferred range of 0.03 to 0.07 inch (1 mm to 2 mm). Steel or other strong metal may be used for the tube.

Unless the tube fits around the rod with minimal clearance, the rod is preferably bonded within the tube with a space-filling, heat resistant adhesive. Suitable adhesives include Cotronics ResBond® 989FS (available from Cotronics Corporation of Brooklyn, N.Y., USA), which is a high temperature ceramic adhesive, and high temperature epoxy resins. A portion of the epoxy resin may burn off at the end closest to the vessel, but the remote end will remain sufficiently cool that the adhesive will remain functional. To avoid the need for adhesives altogether, the tube and rod may be thermally shrink fit together.

As shown in FIG. 2, the end 23 of the rod 12 bears directly against the external surface 49 of the vessel 42 in this exemplary embodiment. In other embodiments, however, it may be desirable to apply the force via an incompressible spacer (not shown) having a larger surface area in order to spread the load on the vessel wall. Such a spacer will preferably be made of a ceramic material, e.g. alumina, and could be made part of, or adhered to, the rod 12 itself. The advantage would be less likelihood of causing damage to the vessel while minimizing thermal conduction due to the use of a narrow rod/broad spacer combination.

As a further alternative, the rod 12 may be made partly of refractory material and partly of metal, with the refractory part positioned adjacent to the vessel contacting end 23. The refractory part may be made long enough to act as a thermal insulator between the vessel and the metal part of the rod.

Although the use of a rod 22 made completely or partly of refractory ceramic material has been described above, it is possible to make the rod entirely of metal, e.g. stainless steel, titanium or inconel (a nickel-chromium based alloy). Clearly, the use of metal rods reduces the likelihood of breakage under compression, but increases loss of heat from the vessel. Furthermore, certain metals may be subject to loss of strength or high temperature creep, so it is advisable to use all-metal rods only in lower temperature applications, e.g. with lower temperature metals and without additional heating of the vessel. In contrast, rods containing or consisting of refractory ceramics are suitable for applications at all temperatures.

Although not specifically shown, the longitudinal ends of the vessel 42 may also be placed under compression from abutting end plates thrust against the vessel ends by bolts and cupped washer assemblies attached to end walls of the metal casing. Isolation rods such as those shown in the Figures are not, however, required at these end wall positions.

The vessel 42 itself may be made from any suitable known ceramic material, e.g. alumina or silicon carbide, and may be made of two or more vessel sections (e.g. 42A and 42B shown in FIG. 3) laid end to end to form a vessel of any desired length.

In the embodiment of FIG. 3, the metal containment vessel 42 is an elongated metal vessel of the kind used in a molten metal distribution system used for conveying molten metal from one location (e.g. a metal melting furnace) to another location (e.g. a casting mold). However, according to other exemplary embodiments, the vessel may be designed for another purpose, e.g. as an in-line ceramic filter (e.g. a ceramic foam filter) used for filtering particulates out of a molten metal stream as it passes, for example, from a metal melting furnace to a casting table. In such a case, the vessel includes a channel for conveying molten metal with a filter positioned in the channel. In another exemplary embodiment, the vessel is a container in which molten metal is degassed, e.g. an Alcan compact metal degasser as disclosed in PCT patent publication WO 95/21273 published on Aug. 10, 1995 (the disclosure of which is incorporated herein by reference). The degassing operation removes hydrogen and other impurities from a molten metal stream as it travels from a furnace to a casting table. Such a vessel includes an internal volume for molten metal containment into which rotatable degasser heads project from above. The vessel may be used for batch processing, or it may be part of a metal distribution system attached to metal conveying vessels. In general, the vessel may be any refractory metal containment vessel positioned within a metal casing. The vessel may also be designed as a refractory ceramic crucible for containing reacting chemicals or chemical species.

Molten metal distribution structures of the kind shown in FIG. 3, but with internal heating means, have been constructed using rods 22 made of alumina, stainless steel and inconel. The vessels were heated to a temperature of approximately 800 to 850° C. at the rod ends while applying a minimum of 1,000 lb (454 Kg) of compressive load to the rods. At these high temperatures, both the inconel and stainless steel suffered from high temperature creep, but would be suitable at the lower temperatures of structures not provided with internal heat. The alumina rods suffered no damage or creep, even when subjected to a compressive load of 5,000 lb (2268 Kg). Rods of alumina are commercially available and relatively inexpensive, thus making them the preferred rods for use in the compressive assemblies.

Figure 4:
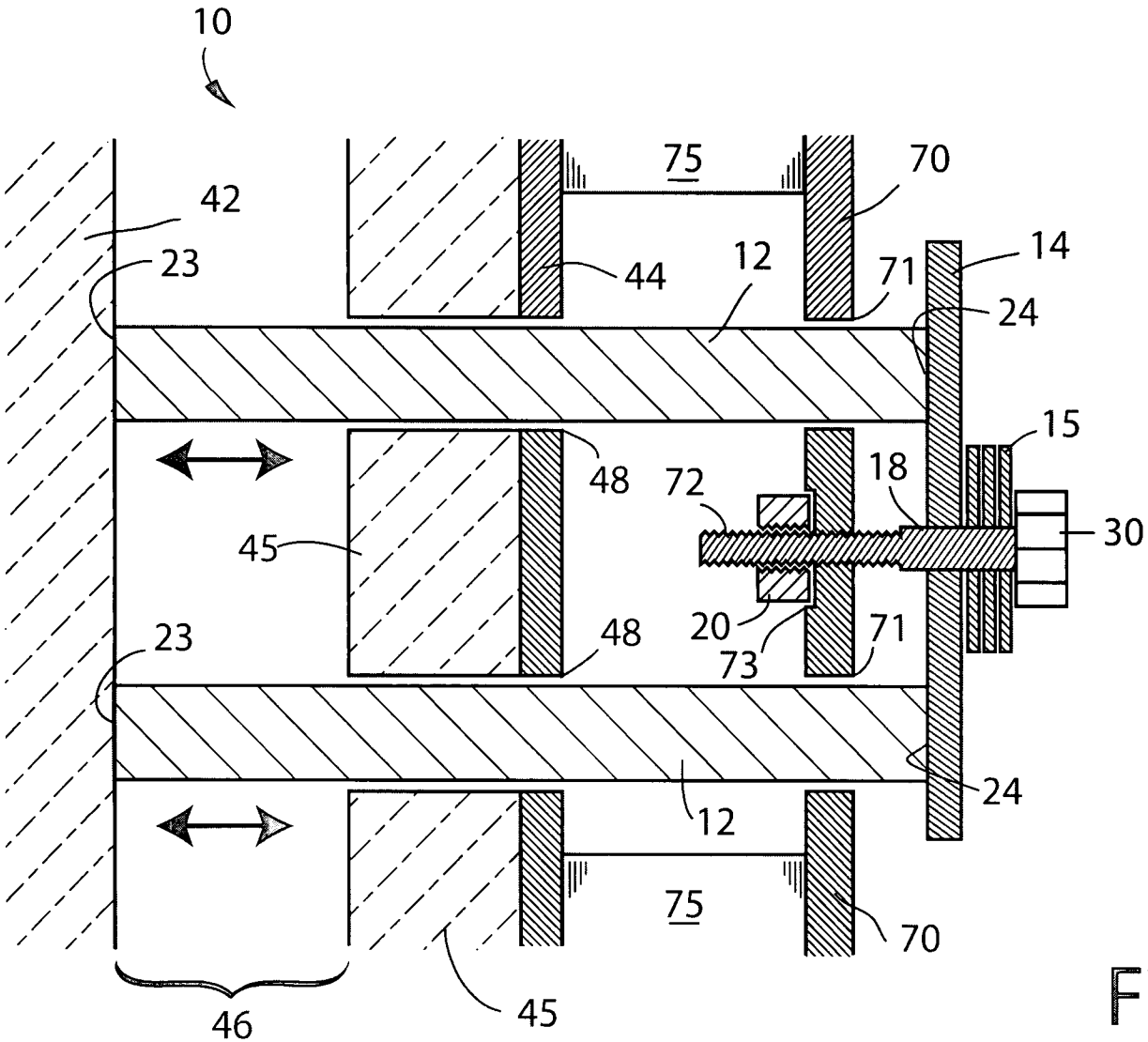
FIG. 4 is cross-section similar to FIG. 2 but showing an alternative exemplary embodiment.

An alternative embodiment is illustrated in FIG. 4. In this case, a pair of elongated rods 12 is securely attached to a plate 14 at one end 24 and contacts the vessel 42 at the other end 23. The rods 12 may be made of rigid ceramic material or metal. The rods extend through holes 48 in the metal casing 44 and insulating layer 45. A supporting plate 70 is provided outside the casing 44 and is rigidly braced against the casing or other fixed support by webs 75. The rods extend through holes 71 in the supporting plate to the plate 14 which is separated by a short distance from the supporting plate 70. A bolt 18 having an enlarged head 30 has a set of cupped spring washers 15 between the head 30 and the plate 14. The bolt extends through holes in the plates 14 and 70 and has an externally threaded region 72. An internally threaded nut 20 with a polygonal outer edge is rotatable on the threaded region 72 of the bolt, but is trapped within a short depression 73 in the underside of the plate 70. The depression 73 is of the same shape and size as the polygonal outer edge of the nut 20 so that the nut cannot rotate relative to the plate. When the bolt 18 is tightened by rotation of the head with a suitable tool, the plate 14 is drawn towards the supporting plate 70 and the rods 12 are pushed into the casing and against the vessel 42, thereby compressing the vessel. The cupped spring washers 15 are also compressed and flattened and exert an outward force on the bolt 18. If the bolt is tightened correctly, expansion and contraction of the vessel 42 is accommodated by corresponding small axial movements of the rods 12 (as represented by the double headed arrows). Such movements are possible because outward movement causes the spring washers 15 to be compressed further between the bolt head 30 and the plate 14, whereas inward movement causes the spring washers to expand (i.e. to assume a more fully cupped shape). Such movements are terminated when the spring washers are fully compressed, or when they are restored to their fully cupped shape (when they no longer push against the plate 14 and hence against the rods 12. In this embodiment, the cupped washers 15 may be replaced, if desired, by a spiral spring washer or a short coiled spring.

As in the previous embodiment, the cupped washers 15 and plate 14 act as a compressive structure between the rods 12 and the bolt 14 that allows limited longitudinal movements of the rods to be accommodated by the compressive structure without requiring corresponding longitudinal movements of the bolt 18.

The rods 12 may be made of metal (e.g. stainless steel) when there is no active heating of the vessel 42, and may be made of refractory ceramic (e.g. alumina) when there is active heating of the vessel, e.g. by means of electrical elements (not shown) provided in the gap 46. As a further alternative, a composite rod having ceramic at one end (the vessel contacting end) and metal at the other may be employed to avoid the use of a long column of ceramic material, that might be brittle. Furthermore, as in the previous embodiment, a ceramic rod reinforced with a metal tube may be employed for the rods 12.

As noted, the rods 12 are provided in pairs to prevent tilting of the plate 14 as force is applied. Alternatively, a single central rod 12 may be employed, with bolts 18 at each end of the plate 14. The bolts would then be tightened at the same time and by the same amounts to avoid undue tilting of the plate.

The invention claimed is:

1. A compressive rod assembly for applying force to a refractory vessel positioned within an outer metal casing, the assembly comprising:

a rigid elongated rod having first and second opposed ends, a bolt having first and second opposed ends, and a compressive structure operatively positioned between the first opposed end of said elongated rod and the first opposed end of the bolt, wherein the compressive structure comprises a compressive element and a plate, and wherein the compressive structure accommodates small axial movement of the elongated rod without requiring corresponding axial movement of the bolt, wherein said elongated rod and said bolt are separate components such that force applied by said bolt to the elongated rod passes through said compressive structure.

2. The assembly of claim 1, wherein said compressive element comprises at least one cupped spring washer positioned operationally between said bolt and one of the first opposed end of the elongated rod or the second opposed end of the elongated rod.

3. The assembly of claim 2, wherein said at least one cupped spring washer is held within a retainer having an axial hole into which one of the first end of said bolt or the second end of said bolt may extend to contact said at least one cupped spring washer.

4. The assembly of claim 3, wherein said plate is positioned between said at least one cupped spring washer and said first end of the rigid elongated rod.

5. The assembly of claim 1, wherein said rigid elongated rod is made of a metal.

6. The assembly of claim 5, wherein said metal is selected from the group consisting of stainless steel, titanium and Ni—Cr based alloys.

7. The assembly of claim 1, further comprising a threaded nut surrounding the bolt, the nut and bolt having inter-engaging threads.

8. The assembly of claim 7, further comprising a bracket trapping said nut and preventing rotation and axial movement of said nut in a direction away from said rigid elongated rod.

9. The assembly of claim 1, wherein said rigid elongated rod has a cross-sectional shape selected from the group consisting of circular, oval, triangular, square, rectangular and polygonal.

10. The assembly of claim 1, further comprising a pair of said rigid elongated rods, wherein the compressive structure acts on the pair of rods simultaneously.

11. The assembly of claim 1, wherein at least a portion of the compressive rod assembly is positioned between a refractory vessel for molten metal and an outer metal casing.

12. A compressive rod assembly for applying force to a refractory vessel positioned within an outer metal casing, wherein at least a portion of the compressive rod assembly is positioned between the refractory vessel and the outer metal casing and wherein the assembly comprises:

a rigid elongated rod having first and second opposed ends, a threaded bolt having first and second opposed ends, and a compressive structure positioned between the first opposed end of said elongated rod and the first opposed end of the bolt, wherein said elongated rod and said bolt are separate components such that force applied by said bolt to the elongated rod passes through said compressive structure which allows limited longitudinal movements of said elongated rod to be accommodated by said compressive structure without requiring corresponding longitudinal movements of said bolt, wherein said rigid elongated rod comprises a refractory heat insulating material adjacent said second opposed end of the rod.

13. The assembly of claim 12, wherein said rigid elongated rod is made in part from said refractory heat insulating material and in part from metal.

14. The assembly of claim 12, wherein said rigid elongated rod is made entirely of said refractory heat insulating material, and is supported within an external metal tube that terminates short of said second opposed end of the rod.

15. The assembly of claim 14, wherein said tube is adhered to said rod by means of a heat resistant adhesive.

16. The assembly of claim 12, wherein said refractory heat insulating material is a ceramic material selected from the group consisting of alumina, zirconia, fused silica, mullite, aluminum titanate and machinable glass ceramics.

* * * * *